US005994684A

United States Patent [19]

Ko

[11] Patent Number: 5,994,684

[45] Date of Patent: Nov. 30, 1999

[54] SURGE CURRENT PREVENTION CIRCUIT OF MICROWAVE OVEN

[75] Inventor: Yeong-Cheol Ko, Suwon, Rep. of Korea

[73] Assignee: Samsung Electronics Co., Ltd., Suwon, Rep. of Korea

[21] Appl. No.: 09/058,174

[22] Filed: Apr. 10, 1998

[30] Foreign Application Priority Data

May 12, 1997 [KR] Rep. of Korea ..... 97-18358
Oct. 16, 1997 [KR] Rep. of Korea ..... 97-53146

[51] Int. Cl.[6] ..... H05B 6/68

[52] U.S. Cl. ..... 219/721; 219/702; 219/757

[58] Field of Search ..... 219/721, 702, 219/723, 757; 363/49; 361/93, 94, 99

[56] References Cited

U.S. PATENT DOCUMENTS 3,317,699 5/1967 Helfer ..... 219/721
4,375,587 3/1983 Perl ..... 219/721
4,481,393 11/1984 Ueda ..... 219/721
4,556,773 12/1985 Yoshiyuki et al. ..... 219/721

FOREIGN PATENT DOCUMENTS 1-115079 5/1989 Japan ..... 219/721

*Primary Examiner*—Philip H. Leung
*Attorney, Agent, or Firm*—Burns, Doane, Swecker & Mathis, L.L.P.

[57] ABSTRACT

A surge current prevention circuit of a microwave oven, where a surge relay is turned on or turned off by a predetermined DC voltage supplied by rectification of a predetermined low voltage, such that cost of parts of the surge current prevention circuit becomes low to thereby reduce the manufacturing cost, and electricity can be decreased and operation of the microwave oven can be stabilized by the constant switching operation time of the surge relay.

6 Claims, 3 Drawing Sheets

SURGE CURRENT PREVENTION CIRCUIT OF MICROWAVE OVEN

BACKGROUND OF THE INVENTION

1. Field of the Invention

The present invention relates to a surge current prevention circuit of a microwave oven, and more particularly to a surge current prevention circuit of a microwave oven adapted to prevent an erroneous operation of a microwave oven which occurs when a surge current generated at an initial operation stage of the microwave oven is infused into a high-voltage transformer.

2. Description of the Prior Art

Generally, a driving circuit of a microwave oven provided with a surge current prevention circuit according to the prior art comprises, as illustrated in FIG. 1, a filtering unit 10, a fan motor 15, a surge current prevention circuit 20, and a high voltage transformer 30.

As illustrated in FIG. 1, the filtering unit 10 serves to eliminate higher harmonics included in a commercial alternating current (AC) voltage supplied through input terminals (A, B). The fan motor 15 receives the AC voltage supplied through the filtering unit 10 from the input terminals (A, B) and is driven thereby to rotate a cooling fan (not shown).

Furthermore, the surge current prevention circuit 20 is provided to prevent a surge current which is generated at an initial operation stage of a microwave oven, where the circuit includes a surge resistor 23, a surge coil 25 and a high voltage alternating current type surge relay 27. A high voltage transformer 30 receives a commercial alternating current AC voltage supplied through the input terminals (A, B) to transform same to a predetermined voltage and to drive a magnetron (not shown).

In the driving circuit thus described, when a user inputs a start key, higher harmonic components are removed by the filtering unit 10 to thereafter be supplied to the fan motor 15 and the surge current prevention circuit 20.

Next, when the cooling fan is rotated, the surge coil 25 starts to be excited by the commercial AC voltage, which is then supplied to the transformer 30. By this, the surge current generated at an initial operation stage of the microwave oven is limited in the course of passing through the surge resistor 23.

Next, when the initial operation stage is over, the surge coil 25 is excited to switch on or switch off the surge relay 27 into an on-state, and by this, the filter commercial AC voltage is directly supplied to the high voltage transformer 30 bypassing the surge resistor 23.

Next, the transformer 30 receives the filtered AC voltage to supply same to the magnetron, which in turn generates microwaves to heat and cook a food article.

In other words, the surge current generated at the initial operation stage of the microwave oven is limited in the course of passing the surge resistor 23, and after the initial stage is over, the filtered commercial AC voltage passes the surge relay 27 to be directly supplied to the high voltage transformer 30.

However, there is a problem in the surge current prevention circuit according to the prior art in that the surge coil is excited by the high voltage of commercial AC voltage, by way of example, 100–200V, to switch on or switch off the surge 27. Also, the component costs of such a surge prevention circuit tend to be high, thereby increasing manufacturing cost and consumed electricity.

There is another problem in that the microwave oven is unstably operated due to inconstant switching operation time.

SUMMARY OF THE INVENTION

The present invention is disclosed to solve the aforementioned problems and it is the object of the present invention to provide a surge current prevention circuit of a microwave oven adapted to form a tap at a predetermined position of a fan motor to supply a predetermined low voltage to a surge coil therethrough and to cause a surge relay to be turned on or turned off thereby, decreasing a manufacturing cost and reducing consumed electricity.

It is another object of the present invention to provide a surge current prevention circuit of a microwave oven by which a predetermined direct current voltage rectified from the predetermined low voltage is supplied to the surge coil to thereby switch on or switch off the surge relay and to stabilize the operation of the microwave oven.

In accordance with one object of the present invention, there is provided a surge current prevention circuit of a microwave oven which has a fan motor for being driven by a commercial alternating current supplied from the outside to thereby rotate a cooling fan, and a surge resistor formed at an input side of a high voltage transformer for transforming the commercial alternating current voltage to a predetermined high voltage, the surge current prevention circuit comprising:

- a surge coil forming a tap at a predetermined position of the fan motor and being excited by a predetermined low voltage supplied therethrough; and
- a surge relay for being turned on or turned off by excitation of the in-rush coil.

In accordance with another object of the present invention, there is provided a surge current prevention circuit of a microwave oven having a fan motor for being driven by a commercial alternating current supplied from the outside to thereby rotate a cooling fan and a surge resistor formed at an input side of a high voltage transformer for transforming the commercial alternating current voltage to a predetermined high voltage, the surge current prevention circuit comprising:

- a rectifying unit for forming a tap at a predetermined position of the fan motor and for rectifying a predetermined low voltage supplied therethrough to a predetermined direct current voltage;
- a surge coil for being excited by the predetermined direct current voltage supplied from the rectifying unit; and
- a surge relay for being turned on or turned off according to excitation of the surge coil.

BRIEF DESCRIPTION OF THE DRAWINGS

For fuller understanding of the nature and objects of the invention, reference should be made to the following detailed description taken in conjunction with the accompanying drawings in which.

DETAILED DESCRIPTION OF THE INVENTION

Hereinafter, a detail description of the surge current prevention circuit of a microwave oven according to the present invention will be described with reference to the accompanying drawings.

Figure 1:
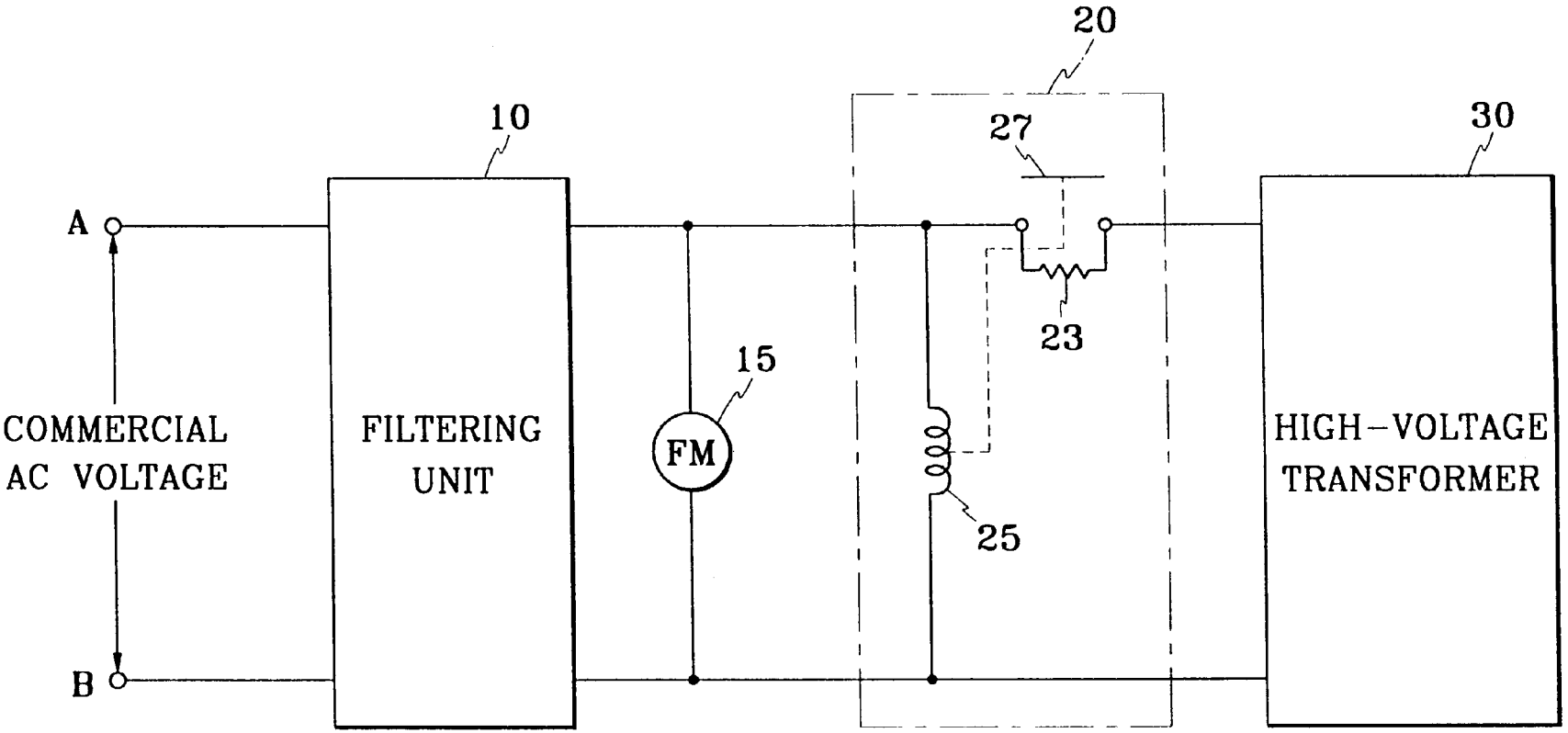
FIG. 1 (PRIOR ART)
FIG. 1 is a schematic diagram for illustrating a microwave oven adapted to have a surge current prevention circuit according to the prior art.
Figure 2:
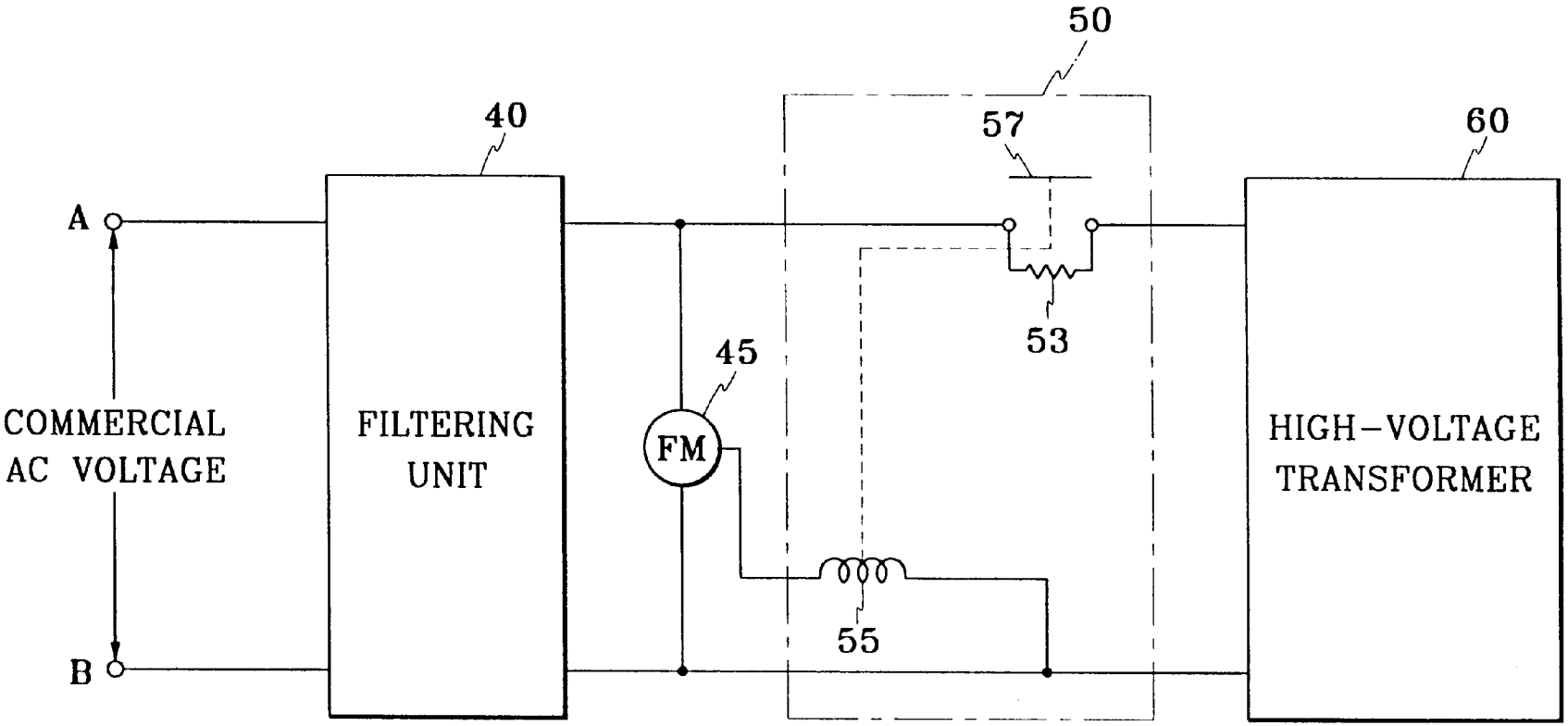
FIG. 2 is a schematic diagram for illustrating a driving circuit diagram of a microwave oven adapted to include a surge current prevention circuit according to a first embodiment of the present invention.
Figure 3:
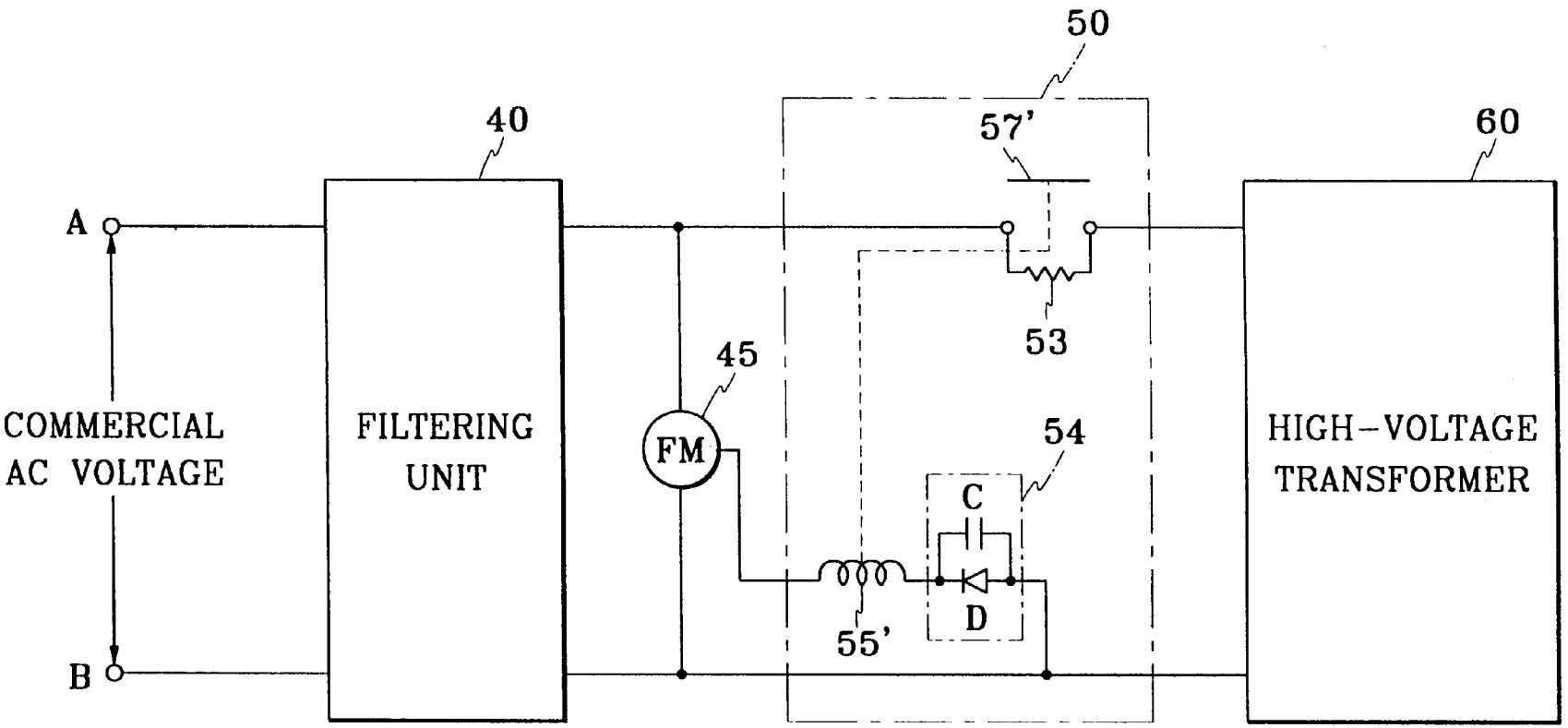
FIG. 3 is a schematic diagram for illustrating a microwave oven adapted to equip a surge current prevention circuit according to a second embodiment of the present invention.

Throughout the drawings in FIGS. 2 and 3, like reference numerals and symbols are used for designation of like or equivalent parts or portions for simplicity of illustration and explanation and redundant descriptions will be omitted.

FIG. 2 is a schematic diagram for illustrating a microwave oven adapted to include a surge current prevention circuit according to the first embodiment of the present invention, where a driving circuit of the microwave oven includes a filtering unit 40, a fan motor 45, a surge current prevention circuit 50 and a high voltage transformer 60.

As illustrated in FIG. 2, the fan motor 45 is driven according to the commercial alternating current AC voltage supplied through input terminals (A, B) to thereby rotate a cooling fan (not shown), and serves to generate a predetermined low voltage through a tap formed at a predetermined position.

Furthermore, the surge current prevention circuit 50 serves to prevent a surge current generated at an initial operation stage of the microwave oven, where the circuit includes a surge resistor 53 for restricting a surge current, a surge coil 55, more specifically, a low voltage AC driving type coil, for being excited by a predetermined low voltage supplied from the fan motor 45 and a surge relay 57, more specifically, a low voltage AC driving type relay, for being turned on or turned off according to excitation of the surge coil 55.

Meanwhile, FIG. 3 is a schematic diagram for illustrating a microwave oven adapted to equip a surge current prevention circuit according to the second embodiment of the present invention, where a driving circuit at the microwave oven includes a filtering unit 40, a fan motor 45, a surge current prevention circuit 50 and a high voltage transformer 60.

In FIG. 3, the surge current prevention circuit 50 serves to prevent a surge current generated at an initial operation stage of the microwave oven, where the circuit comprises a surge resistor 53 for limiting the surge current, a rectifying unit 54 having a diode D and a capacitance C for rectifying a predetermined AC voltage supplied from the fan motor 45 to a predetermined direct current DC voltage, a surge coil 55', more specifically, a DC voltage driver type coil, for being excited by the predetermined DC voltage supplied from the rectifying unit 54 and a surge relay 57', more specifically, a DC voltage driving type relay, for being turned on or turned off according to excitation of the surge coil 55'.

Now, the surge current prevention circuits of a microwave oven according to the present invention thus constructed will be described in detail with reference to FIGS. 2 and 3.

First of all, in the surge current prevention circuit according to the first embodiment of the present invention, when a start key is input after a cooking menu, cooking time and the like are set-up through a key input unit (not shown), higher harmonics components included in the commercial AC voltage supplied through the input terminals (A, B) are removed by the filtering unit 40 to thereafter be supplied to the fan motor 45 and the surge current prevention circuit 50.

Next, the fan motor 45 is supplied with the filtered commercial AC voltage and is driven thereby, to rotate a cooling fan (not shown), and at the same time, serves to generate a predetermined low voltage via a tap formed at a predetermined position, where, the surge coil 55 of the surge current prevention circuit 50 starts to be excited by the predetermined low voltage.

At this time, because the surge relay 57 at the surge current prevention circuit 50 is in an inactive state at an initial stage, the filtered commercial AC voltage is supplied to the high voltage transformer 60 via the surge resistor 53.

Successively, the surge current generated at the initial operation stage of the microwave oven is limited while passing through the surge resistor 23.

Next, when the initial stage is over, the surge coil 55 is excited to turn on the surge relay 57, by which, the commercial AC voltage is directly supplied to the high voltage transformer 60 via the surge relay 57 without passing through the surge resistor 53.

Successively, the high voltage transformer 60 is supplied with the filtered commercial AC voltage to transform the voltage to a predetermined voltage for driving a magnetron (not shown) and to supply same to the magnetron, which generates microwaves for cooking and heating foodstuffs.

Meanwhile, in the surge current prevention circuit of a microwave oven according to the second embodiment of the present invention, when a start key is input after cooking menu, cooking time and the like are established through a key input unit, higher harmonics components contained in the commercial AC voltage supplied through the input terminals (A, B) are eliminated by the filtering unit 40 to thereafter be supplied to the fan motor 45 and the surge current prevention circuit 50.

Next, the fan motor 45 receives the commercial AC voltage and is driven thereby, to rotate the cooling fan and at the same time, serves to generate a predetermined low voltage via a tap formed at a predetermined position. The rectifying unit 54 at the surge current prevention circuit 50 receives a predetermined low voltage output from the fan motor 45 to half-rectify same to a predetermined DC voltage and to supply same to the surge coil 55', which in turn starts to be excited by the predetermined DC voltage.

At this time, because the surge relay 57' at the surge current prevention circuit 50 is under an inactivated state at the initial stage, the commercial AC voltage is supplied to the high voltage transformer 60 through the surge resistor 53.

Successively, an a surge current generated at the initial stage of the microwave oven is limited while it passes through the surge resistor 23.

Next, when the initial stage is over, the surge coil 55' is excited to turn on the surge relay 57', by which, the commercial AC voltage is directly supplied to the high voltage transformer 60 through the surge relay 57' without passing through the surge resistor 53.

The high voltage transformer 60 then serves to transform the commercial AC voltage to a predetermined high voltage for driving a magnetron (not shown) to supply same the magnetron. The magnetron now receives the predetermined high voltage to generate microwaves for heating and cooking foodstuffs.

As apparent from the foregoing, there is an advantage in the surge current prevention circuit of a microwave oven according to the present invention, in that a surge relay is turned on or turned off by a predetermined DC voltage supplied by rectification of the predetermined low voltage, such that cost of parts of the surge current prevention circuit becomes low to thereby reduce the manufacturing cost.

There is another advantage in that consumed electricity can be decreased and operation of the microwave oven can be stabilized by the constant switching operation time of the surge relay.

What is claimed is:

1. A surge current prevention circuit of a microwave oven having a fan motor to be driven by an externally supplied commercial alternating current to thereby rotate a cooling fan and a surge resistor located at an input side of a high voltage transformer for transforming the commercial alternating current voltage to a predetermined high voltage, the surge current prevention circuit comprising:

a surge coil forming a tap at a predetermined position of the fan motor and being excited by a predetermined low voltage supplied therethrough; and a surge relay for being turned on or turned off by excitation of the surge coil.

2. A surge current prevention circuit of a microwave oven having a fan motor for being driven by an externally supplied commercial alternating current to thereby rotate a cooling fan and a surge resistor formed at an input side of a high voltage transformer for transforming the commercial alternating current voltage to a predetermined high voltage, the surge current prevention circuit comprising:

a rectifying unit for forming a tap at a predetermined position of the fan motor and for rectifying a predetermined low voltage supplied therethrough to a predetermined direct current voltage;

a surge coil for being excited by the predetermined direct current voltage supplied from the rectifying unit; and a surge relay for being turned on or turned off according to excitation of the surge coil.

3. A power supply circuit, comprising:

a fan motor being driven by an externally supplied alternating current;

a transformer for transforming said externally supplied alternating current; and a surge current prevention circuit including a surge resistor located at an input side of said transformer through which said externally supplied alternating current must pass, said surge current prevention circuit including a surge coil forming a tap at a predetermined position of the fan motor and being excited by a predetermined low voltage supplied therethrough, and a surge relay being turned on or turned off by excitation of the surge coil, said relay selectively shorting said surge resistor.

4. A power supply circuit in accordance with claim 3, further comprising a filtering unit for receiving and filtering said externally supplied alternating current before said current reaches said fan motor, said transformer or said surge current prevention circuit.

5. A power supply circuit, comprising:

a fan motor being driven by an externally supplied alternating current;

a transformer for transforming said externally supplied alternating current; and a surge current prevention circuit including a surge resistor located at an input side of said transformer, a rectifying unit forming a tap at a predetermined position of the fan motor and rectifying a predetermined low voltage supplied therethrough to a predetermined direct current voltage, a surge coil for being excited by the predetermined direct current voltage supplied from the rectifying unit, and a surge relay for being turned on or turned off according to excitation of the surge coil to selectively short said surge resistor.

6. A power supply circuit in accordance with claim 5, further comprising a filtering unit for receiving and filtering said externally supplied alternating current before said current reaches said fan motor, said transformer or said surge current prevention circuit.

* * * * *